United States Patent [19]

Babunovic

[11] 4,041,963

[45] Aug. 16, 1977

[54] CONTAINER WASHER APPARATUS

[75] Inventor: Momir Babunovic, Des Peres, Mo.

[73] Assignee: Barry-Wehmiller Company, St. Louis, Mo.

[21] Appl. No.: 710,166

[22] Filed: July 30, 1976

[51] Int. Cl.[2] ..... B08B 3/04

[52] U.S. Cl. ..... 134/104; 134/130; 134/147

[58] Field of Search ..... 134/73–75, 134/83, 104, 130, 147, 154, 182–183

[56] References Cited

U.S. PATENT DOCUMENTS

| | | | |
|---|---|---|---|
| 2,710,818 | 6/1955 | Winters | 134/104 X |
| 3,162,204 | 12/1964 | Babunovic et al. | 134/74 |
| 3,868,960 | 3/1975 | Cove et al. | 134/73 |

FOREIGN PATENT DOCUMENTS

| | | | |
|---|---|---|---|
| 1,090,784 | 4/1955 | France | 134/130 |

*Primary Examiner*—Robert L. Bleutge
*Attorney, Agent, or Firm*—Gravely, Lieder & Woodruff

[57] ABSTRACT

Container washer apparatus for removing labels from the containers and from the apparatus as soon as possible by means causing washing solution agitation through the container conveying pockets into the area between the down and up passes of the conveyor movement in the washing solution tank, and by cooperating means effecting controlled transfer of the removed labels out of the tank.

12 Claims, 12 Drawing Figures

CONTAINER WASHER APPARATUS

BACKGROUND OF THE INVENTION

The problem of getting labels to detach from containers is one of long standing, and a related problem is one of removing the detached labels from the tanks containing the washing solution. The washing solution has traditionally been hot caustic for attacking the glue used to affix the labels and concurrently effecting sterilization of the containers preparatory to filling.

An early effort to solve the problem of label detachment and removal was made by the use of oscillating paddles located in one or more tanks in the upper zone of the washing solution therein for the express purpose of sloshing the solution through the conveying pockets in which the containers were placed for the travel through the washer apparatus. Not much good effect was accomplished by this approach due to the unrecognized events that occured when the paddle was oscillated between the deflector or guide means necessary to keep the containers in the conveyor pockets. Accordingly the detached labels merely oscillated in rhythm with the paddle and often time hung on the deflectors or returned to the conveyor where they become reapplied to the containers. The problem has remained acute due to the large number of labels found to be present in the tanks at or near the discharge of the containers from the washed apparatus.

Certain early usage of oscillating paddles in the upper zone of the washing solution is seen in the Meyer Dumore Bottle Cleaner of Geo. J. Meyer Manufacturing Co., Milwaukee, Wis., or Liquid Carbonic Company Ltd, London, both of which are illustrated in the May, 1953 Schweizer Brauerei-Rundschau, Swiss Review of Breweries. Another use of oscillating paddles is found in Babunovic et al. U.S. Pat. No. 3,162,204, granted Dec. 22, 1964. On study of these washers it can be appreciated that as the paddle oscillates and moves from one extreme position to the other the washing solution curls around the lower edge and rises into the low pressure zone directly behind the paddle. The result is that the washing solution is caused to oscillate in the container pockets so that the detached labels also oscillate and do not make rapid transfer to places where collection can occur. Also, these prior art arrangements made the whole tank a label collector which makes the job of collecting the labels more difficult as they are spread over a large area, and a proportion of the labels are deposited again on the container.

BRIEF DESCRIPTION OF THE INVENTION

This invention relates to container washer apparatus and particularly to improved washing fluid activating means for detaching labels from the containers by directing a flow of solution over the containers, and for transferring the labels to a place where they can be conveniently withdrawn by suitable means and out of the apparatus as soon as possible.

An important object of this invention is to establish in a tank containing container washing solution substantially one-way flow of the washing solution through container carrying pockets of a conveyor while retaining the containers in the pockets so that labels may be washed off of the containers in a direction that will substantially avoid the possibility of the labels being reapplied to the containers or hanging up in the conveyor pockets, and to accomplish that important object by means of an improved paddle operable in an oscillating manner between the entry and exit paths of the conveyor to agitate the washing solution and establish a principal direction of washing solution flow which is inwardly toward the space between the entry and exit paths of the conveyor where other means will become effective to remove the labels from the apparatus.

Another object of the present invention is to provide one or more compartments in a container washer with paddle means operably mounted between the passes of container conveyor means to agitate the adjacent strata of the washing solution, together with means carried by the paddle and responsive to oscillations thereof for cooperating with container guide means to cause controlled flow of the washing solution such that the labels on the containers are subjected to the flushing action of the resulting flow.

Still another object of the present invention is to obtain greater flushing action from a paddle agitator submerged in the washing solution by providing the paddle agitator with solution pumping means in the form of a flushing control flapper element which flexes so as to trail the direction of paddle agitator movement in the washing solution, providing baffle means adjacent the path of conveyance of containers in position to cooperate with the flapper element at each reversal of paddle movement, thereby utilizing the pumping action of the paddle and flapper element to accelerate the flow of washing solution over the containers to improve the flushing action for the purpose of label removal.

In a presently preferred embodiment the improved apparatus for washing containers and removing labels therefrom comprises pockets container conveyor means movable through a tank containing the washing solution in a path having down and up passes joined above the tank bottom in a looped pass, retainer means following the conveyor path to keep the containers in the conveyor pockets, washing solution agitating means extending into the washing solution in the upper zone and oscillating back and forth between the retainer means, and washing solution flow control means carried by the agitator means and cooperating with the retainer means to create a principal flow in the washing solution downwardly in the tank toward the conveyor looped pass where other means is effective to move the washing solution burdened with labels out of the apparatus, whereby the principal flow induces the washing solution to move through the conveyor pockets and over the containers toward the space between the down and up passes of the conveyor.

BRIEF DESCRIPTION OF THE DRAWINGS

In order to disclose the presently preferred organization of components for improving the removal of labels from containers, reference is directed to the several views of the accompanying drawings, wherein.

DETAILED DESCRIPTION

Figure 1:
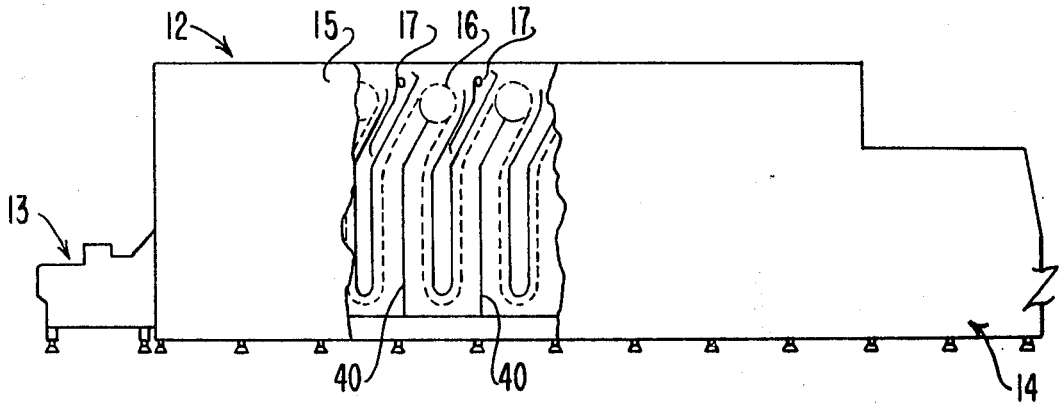
FIG. 1 is a side view of a container washer to illustrate the general location of the conveyor, the tanks and other features of the apparatus of this invention.

FIG. 1 is a schematic view of a container washer apparatus 12 having a feed end 13 and a discharge end 14. The general frame for the operating components is seen at 15 with a portion broken away to show two washing solution containing tanks and the placement of the pocket conveyors 16 and agitator paddles 17. No attempt is made in this view to include details which will be more fully set forth in other views of the drawings.

Figure 2:
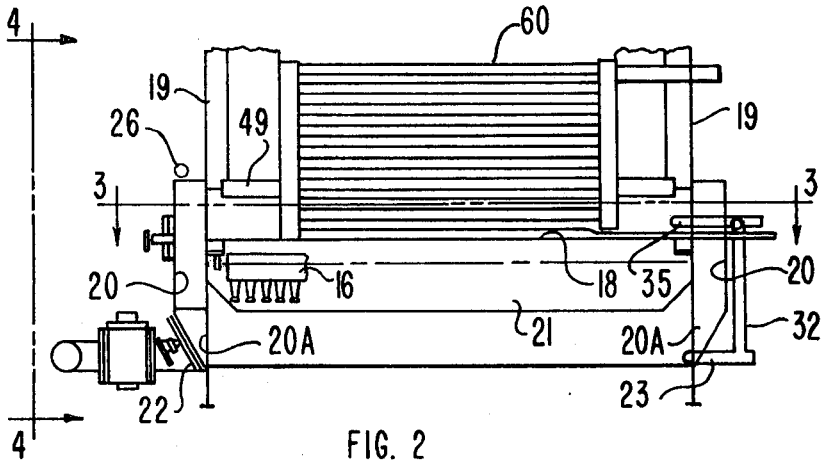
FIG. 2 is a fragmentary transverse section through a washing solution tank showing certain features of arrangement of components which cooperate in collecting and removing labels.

FIG. 2 is a fragmentary transverse section through a tank to show the placement of the means to collect detached labels in a trough 18 set in the bottom loop of the pocket conveyor 16 for moving containers through the tank. The trough 18 opens at its opposite ends through the side walls 19 into blister passages 20 which extend down to open at 20A into the bottom of the tank below baffle means 21. The baffle means 21 extends beneath the path of the conveyor 16, but is formed with an opening 21A (See FIG. 3) below trough 18 so that the trough acts in part as a baffle while allowing broken container parts to fall through to the tank bottom where such parts may, from time to time, be removed through the clean-out access opening sealed by removable cover 22.

Figure 3:
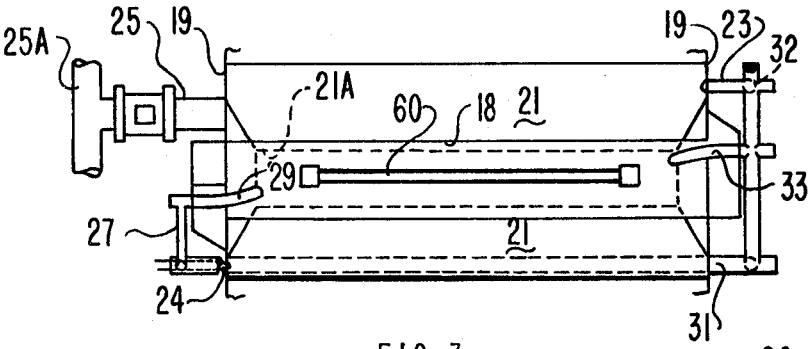
FIG. 3 is a fragmentary plan view taken along line 3—3 in FIG. 2.
Figure 4:
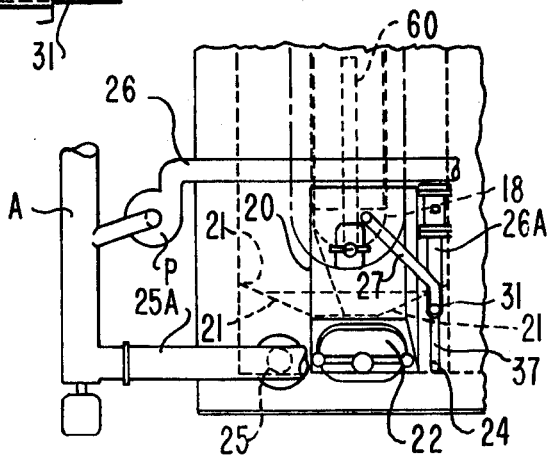
FIG. 4 is a fragmentary view taken at line 4—4 in FIG. 2 to illustrate additional features.

FIGS. 3 and 4, along with FIG. 2, show in schematic form a system for clearing collected labels out of the trough 18, by directing them through the blister passages 20 into the tank bottom below the baffle means 21, and for removing them from the tank bottom. The washing solution burdened with labels is continuously directed by currents of fluid discharged at nozzles 23 and 24 in a pattern of movement which concentrates on the outlet conduit 25. The conduit 25 is associated with a manifold or collector conduit 25A which runs to a label separator device A which extracts the labels and pulpy material and returns substantially clean fluid (which is of course the washing solution in the tank) by manifold pipe 26 to the branch pipe 26A. The pipe 26A feeds a first pipe 27 which connects with feed pipe 28 for nozzle 29 located in and at one side of the trough 18. In addition, pipe 26A feeds a cross-over pipe 31 which runs through the tank to the opposite side, where one branch pipe 32 feed tank bottom nozzle 23, and a second branch feeds a pipe 34 for nozzle 35 in the opposite side of the trough 18 from nozzle 29. Further, the pipe 26A connects with a branch pipe 37 for feeding tank bottom nozzle 24. What has been generally described herein in connection with FIGS. 2, 3 and 4 is the subject described and claimed, per se, in a co-pending application of Babunovic et al., Ser. No. 669,043, filed Mar. 22, 1976.

Figure 5:
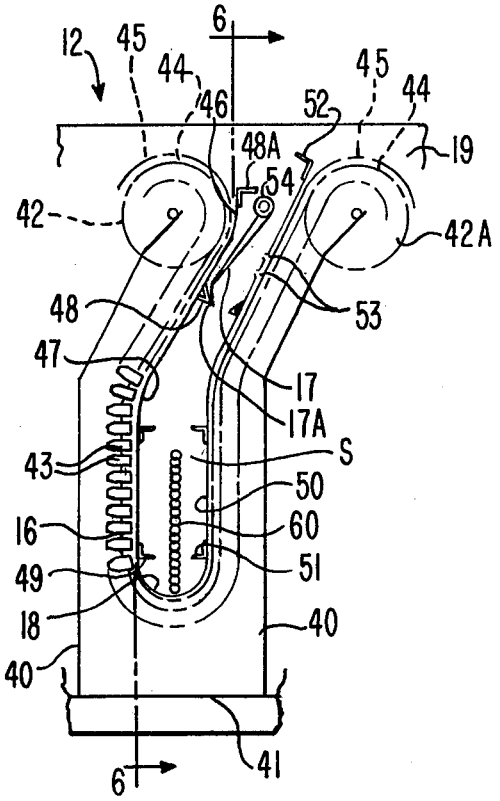
FIG. 5 is a fragmentary and schematic elevation view of apparatus arranged in one compartment in the container washer seen in FIG. 1.
Figure 6:
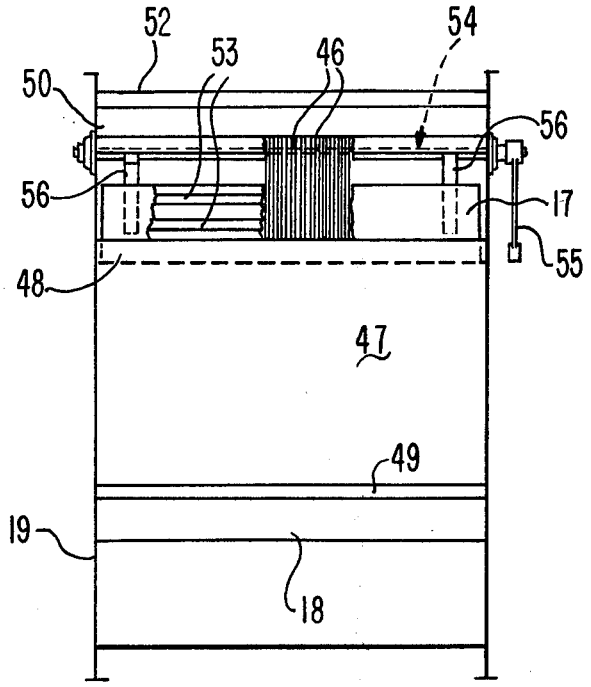
FIG. 6 is a view seen along the line 6—6 in FIG. 3 with portions broken away to show certain important details.

FIGS. 5 and 6 illustrate the preferred placement of the components which are embodied in this invention. The washing solution is held in a tank represented by walls 40 which extend from the bottom 41 upwardly to the shafts for the conveyor chain sprocket wheels 42 and 42A. The container pockets 43 are moved by a suitable chain represented by the chain pitch line 44. The open base ends of the pockets 43 follow the path represented by the line 45 so that as the pockets pass over the sprocket 42 the open ends move into closely spaced relation to guide means which retains the containers in the pockets 43. The guide means is represented in the upper section by a series of spaced bars 46 (FIG. 6) which do not allow passage of the containers but will allow flow therethrough of washing solution burdened with labels. Below the section of bars 46, the guide becomes a solid sheet 47 from the upper support bracket 48 down to a connection at the bracket 49 for the margin of the trough 18. The pocket conveyor, therefore, has a down pass through the depth of the washing solution to the trough 18 where it loops around and ascends in an up pass along another guide sheet 50 which is supported by bracket 51 at the trough 18 and extends upwardly to the top bracket 52 at the sprocket 42A. However, this guide sheet is interrupted by one or more slots which may be formed between vertical bars or a plurality of horizontal slots 53 (two being shown) at the elevation opposite to the bars 46. Thus, the solid sheets 47 and 50, forming the guides for retaining the containers in the pockets 43, enclose a vertically elongated space S which bottoms out at the trough 18.

The upper open end of the space S receives an oscillatory shaft 54 operated at one external end by a lever 55 connected to suitable drive means (not necessary to show). The shaft 54 carries depending arms 56 which support the paddle 17. The paddle oscillates back and forth in a controlled motion between the bars 46 in the guide for the down pass of the conveyor pockets 43 and the horizontal slots 53 in the guide sheet 50 for the up pass of the conveyor pockets 43, such that the greatest velocity is in the middle portion of the stroke. The paddle 17 penetrates the upper strata of the washing solution so that its lower margin is continually submerged and is located below the bars 46 and slots 53. During paddle oscillation the washing solution is normally caused to oscillate in rhythm. A unique improvement is in providing a flexible flapper element 17A along the lower edge of the paddle 17 so that as the paddle moves in a given direction the flapper element will wave and trail behind. This unique feature will now be described in connection with the views of FIGS. 7 to 11.

Figure 7:
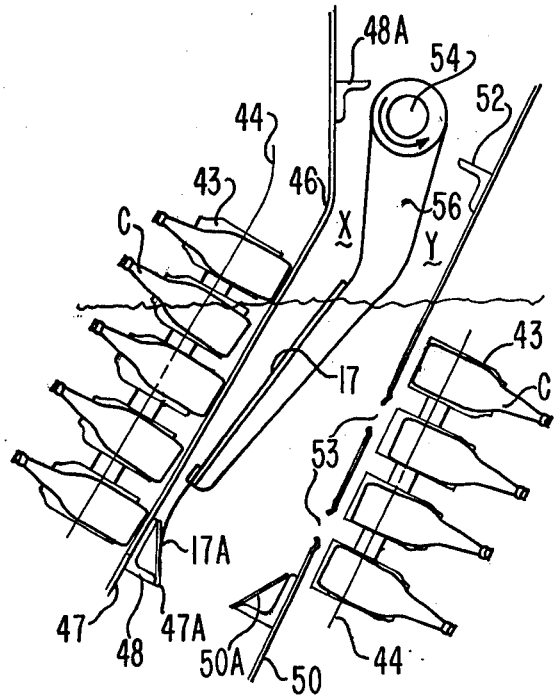
FIG. 7 is an enlarged and fragmentary view of washing solution agitator means embodying the present improvement, the agitator being in an initial position.
Figure 8:
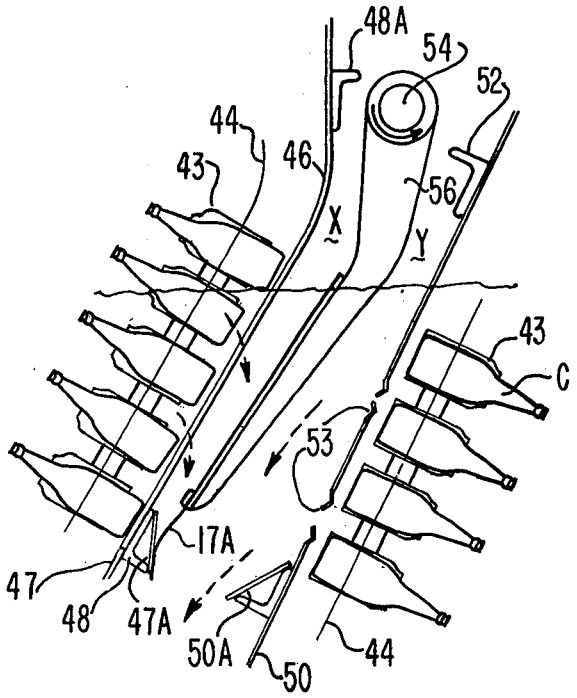
FIG. 8 is a view similar to that of FIG. 7, but showing diagrammatically the action which takes place upon an initial movement of the agitator.
Figure 9:
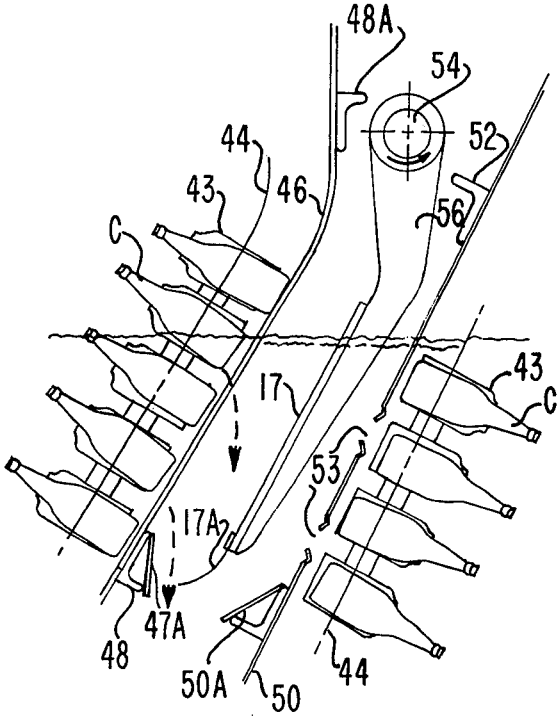
FIGS. 9 and 10 are views similar to FIG. 7, but showing the action of the agitator in a more advanced movement.

FIG. 7 illustrates the start of a paddle oscillation from left to right away from the guide bars 46 which form vertically elongated slots from the bracket 48 to the support bracket 48A at the upper ends. The conveyor pockets 43 with the containers C therein move downwardly as indicated by the arrow. The flapper element 17A is positioned to lie flat against a baffle lip 47A supported by the bracket 48 so that the space X to the left of the paddle has a considerable smaller volume than the space Y to the right. Oscillation of the paddle to the right, as in FIG. 8, creates a low pressure in space X and a high pressure in space Y. This has been observed, and is due to the higher pressure in space Y pushing on the flapper element 17A to prevent it moving with the paddle by holding it against the fixed lip 47A. As the paddle 17 continues to move rightwardly, as in FIG. 8, the space X enlarges and the space fills with washing solution drawn through the slots between bars 46 from the space through which the conveyor pockets move. Thus, a principal flow is created through the pockets 43 with sufficient authority to sweep the labels off the containers and out of the pockets. In the same time period, the washing solution in the space Y is under increasing pressure. The washing solution is induced by the higher or increasing pressure to follow the path of least resistance downward into the space S below flapper 17A.

Figure 10:
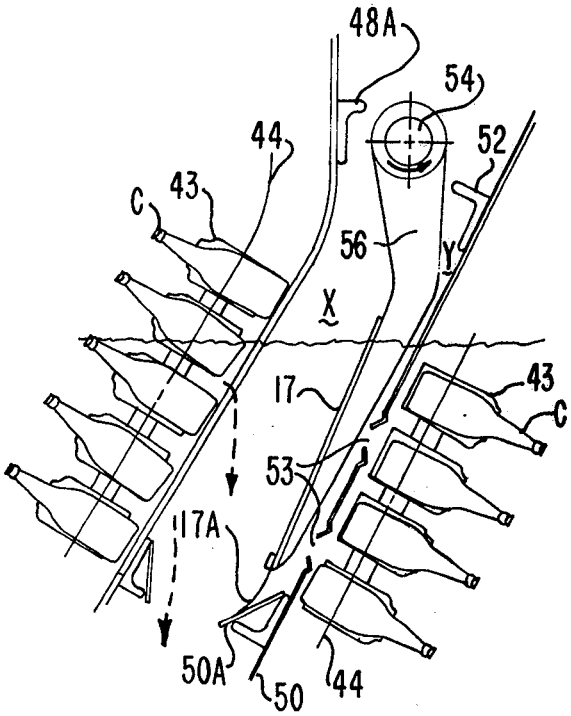

After the paddle has passed the mid position (FIG. 9) the flapper 17A will break contact with the fixed lip 47A. The exact paddle location at the instant contact is broken is dependant on the physical dimensions of flapper, flapper flexibility, changes in fluid dynamics caused by paddle motion. This action is accompanied with a rush of washing solution downward between the flapper 17A and lip 47A, due to the momentum of the principal flow directed rightwardly through the slots between bars 46. Thus, labels are caused to move along with this flow downwardly into the space S. Concurrently the solution in front of the flapper will be forced downwardly into space S. The paddle 17 completes one phase of a complete oscillation when the position of FIG. 10 is attained, and trailing flapper 17A will now move into contact on the surface 50A supported on the guide sheet 50 below the horizontal slots 53.

Figure 11:
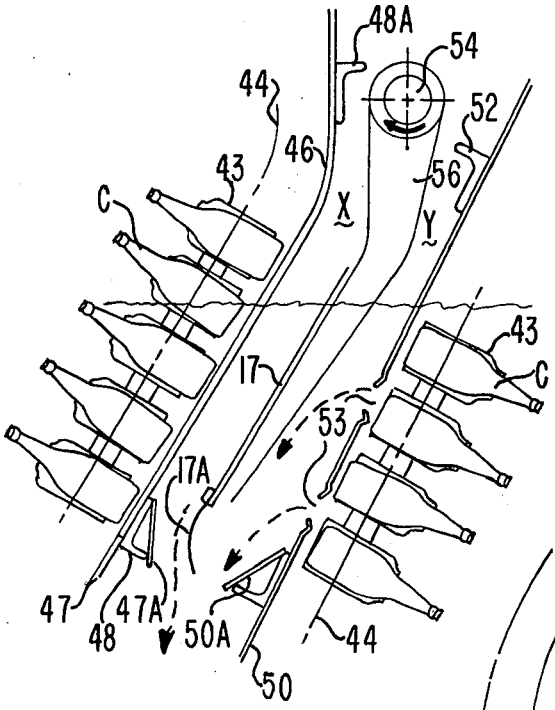
FIG. 11 is a view similar to FIG. 10, but showing diagrammatically the action which occurs upon reverse movement of the agitator.

The return movement of paddle 17 is illustrated in FIG. 11 where the motion is from right to left. It is now understood that the space Y to the right of the paddle 17 will undergo an increase in volume while the space X will be reduced in volume. During the initial movement the flapper 17A will remain in contact with the surface 50A to copy the action shown in FIGS. 8 and 9. Thus, the reverse pressure difference will be created and washing solution in space X will be pushed down into space S because the momentum in the flow previously built up, as in FIGS. 8 and 9, will resist reversing and very little return of labels will take place from right to left between bars 46. Concurrently the space Y will enlarge and draw in washing solution and labels through slots 53, and this flow will be directed down toward the space S after the flapper 17A breaks contact with the surface 50A.

The unique action that has taken place in the sequence of movements of paddle oscillation is that the flapper 17A has effectively cut off the usual circulation of the washing solution around the bottom edge of the paddle which does occur in prior art paddle means. In preventing this circulation the paddle 17 and its flapper 17A function as a pump to continually force washing solution burdened with labels to descend into the space S and collect in the bottom trough 18 seen in FIG. 5.

The washer apparatus seen in FIG. 1 may have one or more of the washing solution tanks provided with oscillating paddles 17 having the flexible flappers 17A as set forth above. Each such tank will accommodate the arrangement of components shown in FIGS. 5 and 6. The pumping action of each paddle 17 and its flapper 17A will move at such speed that the flapper will "fish tail" or wave in trailing fashion but eventually catch up and engage either the lip 47A or the surface 50A on guide 50 and exhibit a reluctance to leave because of the pressure difference in front of and behind the paddle 17. The speed of oscillation is selected also to attain the optimum of continuity of the principal flow of washing solution burdened with labels inwardly through the slots between bars 46 and through the slots 53 and into the space S where the labels can descend and be accumulated in the trough 18.

In a washer apparatus of the general character shown in FIG. 1, the use of the foregoing paddle agitator 17 and "fish tail" flapper 17A in two or three adjacent tanks will generally clear very nearly all of the labels from the containers and cause them to reach the troughs 18. Furthermore, the pumping action set up by the oscillating paddles 17 and flapper elements 17A is strong enough to force a flow of the washing solution burdened with labels through the blister passages 20 into the bottom below the baffles 21. Removal of the labels from the bottom of the tanks is effected by the suction effect at the exit 25, as the label separator device A is provided with a pump P for the purpose of moving the washing solution burdened with labels into the means for extracting the labels and returning the washing solution free of labels to the tank.

This unique pumping action which gets labels into the trough 18 is assisted by the addition of jet nozzles in the trough 18 and in the tank bottom, all as shown and described in FIGS. 2, 3 and 4. The two activities occur simultaneously so there is established a continuous flow system for flushing labels out of the conveyor pockets, capturing the labels in the enclosed space S where they are prevented from fouling the conveyor pockets, and removing the labels completely from the apparatus through the use of a separator, device of any convenient character, external to the washer apparatus 12.

Figure 12:
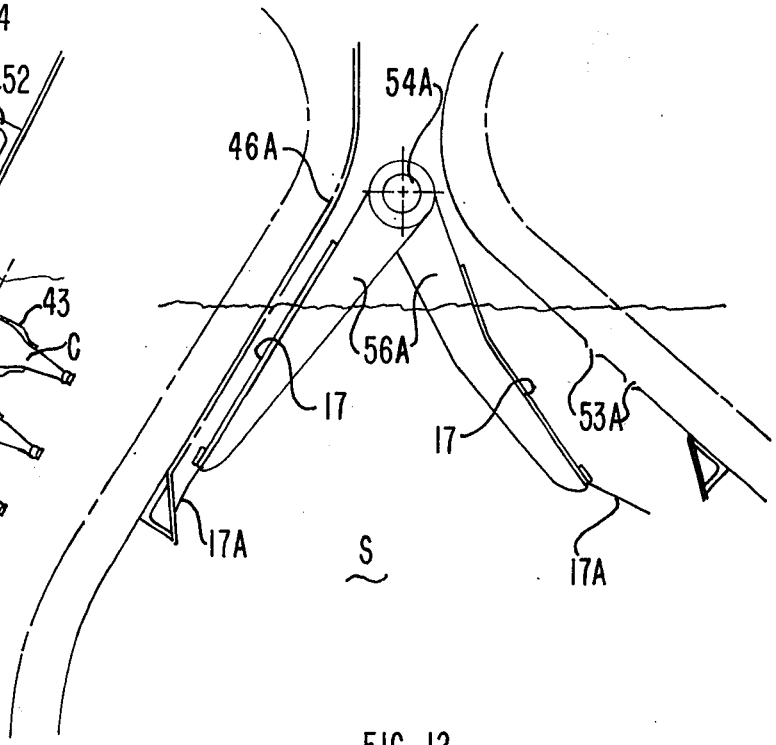
FIG. 12 is a fragmentary elevation and schematic view of a modified washing solution agitating means.

The schematic view of FIG. 12 embodies a variation of the agitator paddle 17 when the shape of the space S is laterally enlarged so that the bars 46A and slots 53A are angularly divergent and widely spaced. In such situation, the oscillating shaft 54A supports pairs of arms 56A which are angularly divergent. Each set of arms 56A carries a paddle 17 and a flexible flapper 17A. The arms have a fixed relation so that the stroke of the means driving the shaft 54A is the same as for the shaft 54 in FIG. 7. Thus, both arrangements seen in FIGS. 7 and 12 can be accommodated in the same washer apparatus. The pumping action of the arrangement seen in FIG. 12 is substantially the same as the action described for the several views of FIGS. 7 to 11.

Returning to FIGS. 2 to 5, the washing solution in the tank is heated by a single plane steam coil 60 which is located to extend longitudinally in the trough 18 to divide the trough into two passages of flow, and to cut off interference between the jet action from nozzle 29 in one passage and the jet action from nozzle 35 in the opposite passage. Thus, the movement of washing solution burdened with labels toward the opposite blister passages 20 is made more efficient, and the heat exchange is also improved as the labels do not collect and act as an insulation layer.

The development of the pumping action by paddle agitator 17 and its flapper element 17A will allow a reduction in the pressure of the fluid to the several nozzles 23, 24, 29, and 35. Consequently the detached labels are handled in the flow in a gentle manner which means that less pulping of labels takes place. The advantage of this is reduced power for feeding the nozzles, less contamination of the caustic washing solution by pulp, and the delivery from the washer of containers free of residual material from the pulp as the final rinse section is able to clear residual material faster.

What is claimed is:

1. In apparatus for washing containers and removing labels therefrom, comprising: a washing tank containing washing solution; container conveyor means directed through said tank in a path having down and up passes joined in a looped pass spaced above the tank bottom, said conveyor means having container pockets open at opposite ends with the pockets aligned in rows transversely of the direction of travel along said path; fixed retainer means following the path of travel of said conveyor in position to retain the containers in the pockets; washing solution agitator means operably mounted adjacent said tank and extending downwardly into the washing solution in the upper zone thereof, said agitator means being movable alternately back and forth between said retainer means to establish flow of washing solution over the containers and through the container pockets; and washing solution flow control means cooperating with said agitator means and being located in position to force the washing solution to flow downwardly in said tank toward said looped pass of said conveyor means, whereby said flow of washing solution over the containers and through said pockets follows the alternate movement of said agitator means away from said container retainer means to effect label removal inwardly between said down and up passes of said conveyor means.

2. The apparatus according to claim 1, wherein said washing solution flow control means includes a flapper element carried by said agitator means in position to trail the direction of movement thereof.

3. The apparatus according to claim 1, wherein said washing solution flow control means includes an impervious flapper element of flexible material undulating the washing solution between the down and up passes of said conveyor.

4. The apparatus according to claim 1, wherein said washing solution flow control means consists of a flapper element carried by said agitator means, and fixed surfaces on said retainer means in position to be engaged alternately by said flapper element and to cooperate with the flapper element in directing the flow of washing solution downwardly in said tank.

5. The apparatus according to claim 1, wherein said fixed retainer means includes portions adjacent said agitator means providing openings to allow flow of washing solution but arrest container displacement from said conveyor pockets and portions below said flow control means impervious to washing solution flow to cooperate with said agitator means in directing the downward flow of washing solution burdened with labels.

6. The apparatus according to claim 1, wherein said fixed retainer means in the down pass of said container conveyor includes vertically directed bars spaced apart to form vertically directed slots in the upper zone of the washing solution, and said fixed retainer means in the up pass of said container conveyor includes at least one horizontally directed slot in the upper zone of the washing solution and opposite to said vertically directed slots.

7. The apparatus according to claim 1, wherein said fixed retainer means below said upper zone of the washing solution encloses a space within the path of travel of said container conveyor in said down, up and bottom loop passes, and said retainer means in said bottom loop opens into the tank bottom to pass labels into the tank bottom.

8. The apparatus according to claim 7, wherein a conduit is connected into the tank bottom to receive washing solution burdened with labels exiting from the washing tank.

9. In apparatus for washing containers and removing labels from the containers and from the apparatus, comprising: a washing tank containing washing solution; container conveyor means directed through said tank in a path having down and up passes joined in a loop pass spaced above the tank bottom, said conveyor means having container pockets open at opposite ends; means extending along said conveyor path in position to retain the containers in said conveyor pockets, said retainer means including slotted openings submerged in the upper zone of the washing solution, impervious wall extending along the down and up passes of said conveyor and a trough in said loop pass; passage forming means connecting said trough with the area adjacent the tank bottom below said trough; discharge conduit means connected into the tank bottom to receive washing solution burdened with labels; pipe means connected into said tank to feed washing solution free of labels thereto; and oscillatory means mounted in said tank in the upper zone of the washing solution between said slotted openings in said retainer means, said oscillatory means including a washing solution agitator paddle and a flapper element carried thereby in position to move with said paddle and alternately engage with said retainer means below said slotted openings and establish alternating high and low pressure regions adjacent said slotted openings, whereby said paddle and flapper element force washing solution to flow through said slotted openings drawing labels therewith and by the alternating high pressure to flow downwardly into said trough and through said passage forming means into the tank bottom.

10. The apparatus according to claim 9, wherein said label separator means is connected between said discharge conduit and said pipe means to receive washing solution burdened with labels from said discharge conduit and return washing solution free of labels to said pipe means, said separator means assisting said paddle and flapper element to maintain washing solution flow.

11. The apparatus according to claim 9, wherein said feed pipe means includes washing solution discharge nozzles positioned in said trough to assist movement of washing solution burdened with labels into said passage forming means.

12. The apparatus according to claim 9, wherein said passage forming means connects said trough at opposite ends into the area adjacent the tank bottom below said trough; said feed pipe means includes at least two washing solution discharge nozzles positioned in said trough in spaced relation to assist movement of washing solution burdened with labels into said passage forming means; and heat exchange means positioned in said trough to heat the washing solution and separate the nozzle discharge into paths substantially free of interference.

* * * * *